US011428493B2

(12) United States Patent
Uhr

(10) Patent No.: US 11,428,493 B2
(45) Date of Patent: Aug. 30, 2022

(54) BARREL MECHANISMS FOR FIREARM TRAINING

(71) Applicant: LASER AMMO LTD., Great Neck, NY (US)

(72) Inventor: Oren Louis Uhr, Rishon Lezion (IL)

(73) Assignee: LASER AMMO LTD., Great Neck, NY (US)

( * ) Notice: Subject to any disclaimer, the term of this patent is extended or adjusted under 35 U.S.C. 154(b) by 359 days.

(21) Appl. No.: 16/810,284

(22) Filed: Mar. 5, 2020

(65) Prior Publication Data

US 2020/0348100 A1 Nov. 5, 2020

Related U.S. Application Data

(60) Provisional application No. 62/814,309, filed on Mar. 6, 2019.

(51) Int. Cl.

| | |
|---|---|
| ***F41A 33/00*** | (2006.01) |
| ***F41A 21/12*** | (2006.01) |
| ***F41A 33/02*** | (2006.01) |
| ***F41A 33/06*** | (2006.01) |
| ***F41A 15/00*** | (2006.01) |
| ***F41A 21/00*** | (2006.01) |
| *F41G 3/26* | (2006.01) |

(52) U.S. Cl.

CPC ..... *F41A 33/00* (2013.01); *F41A 15/00* (2013.01); *F41A 21/00* (2013.01); *F41A 21/12* (2013.01); *F41A 33/02* (2013.01); *F41A 33/06* (2013.01); *F41G 3/2655* (2013.01)

(58) Field of Classification Search

CPC ..... F41A 33/00; F41A 33/02; F41A 33/04; F41A 33/06; F41A 15/00; F41A 21/00; F41A 21/12; F41G 3/26; F41G 3/2655

See application file for complete search history.

(56) References Cited

U.S. PATENT DOCUMENTS

| | | | | |
|---|---|---|---|---|
| 2014/0356816 | A1* | 12/2014 | Zusman | F41A 33/00 434/16 |
| 2015/0198404 | A1* | 7/2015 | Campbell | F41A 9/65 42/70.11 |
| 2017/0082390 | A1* | 3/2017 | Morgan | H04B 1/04 |

* cited by examiner

*Primary Examiner* — Timothy A Musselman

(74) *Attorney, Agent, or Firm* — Mark David Torche; Patwrite Law

(57) ABSTRACT

A firearm training barrel for a replica gun, the gun having a slide and a magazine with a follower. The barrel includes an extended or extendable member positioned or positionable to simulate the presence of one or more pellets in the magazine, whereby the replica gun can be fired even after the magazine's follower has reached the top of the magazine.

7 Claims, 10 Drawing Sheets

BARREL MECHANISMS FOR FIREARM TRAINING

CROSS REFERENCE TO RELATED APPLICATIONS

This application claims priority from U.S. Provisional Patent Application No. 62/814,309, filed 6 Mar. 2019, entitled "Barrel Mechanisms for Firearm Training", which is incorporated in its entirety herein by reference.

FIELD OF THE INVENTION

The present invention relates to simulation firearms, in particular firearm barrels and mechanisms therefor.

BACKGROUND OF THE INVENTION

One type of training firearm uses a laser beam to simulate a point of expected impact or hit. A training barrel for such purpose is disclosed in U.S. Pat. No. 8,568,143 (Uhr, 2013 Oct. 29) describing a firearm barrel configured for use with a blank cartridge and a light emitting training cartridge to operatively simulate live fire training, and which can be used with a system for registering "hits" during simulated exercises and/or gaming with a handheld firearm. U.S. Pat. No. 8,568,143 is incorporated by reference herein in its entirety.

There are also gas operated replica weapons or toy guns generally referred to in the industry as "Airsoft" or "BB" guns. These guns are a type of very low-power guns designed to shoot spherical projectiles such as plastic or metal pellets using compressed gas. These replicas are generally not considered as weapons and are referred to as "non-guns". These guns can be used for target practice and entertainment. The terms "Airsoft", "BB guns", "replica" and "non-guns", and their derivatives, are used interchangeably herein.

The slide is a component on most semi-automatic pistols that moves during the operating cycle and houses the firing pin/striker and the extractor, and serves as the bolt. The slide is spring-loaded so that after it has moved to its rearmost position in the firing cycle, the spring returns the slide to its starting position and chambers the subsequent cartridge/round/pellet, unless the magazine is empty. The terms "round", "cartridge" and "pellet", and their derivatives, are used interchangeably herein.

Each time the semi-automatic pistol is fired, the resultant recoil forces the slide back, which ejects the spent casing or shell and cocks the hammer or striker for the next shot; and then loads another cartridge/round into the chamber when the spring moves the slide forward again (if the magazine still contains a round). If the magazine is empty, the magazine's follower will be at the top of the magazine and mechanically press on a slide blocker/slide stop to prevent the slide from moving forward, because there is no round to be chambered. This indicates to the shooter that it is time to replace the magazine. The terms "shelf" and "casing", and their derivatives, are used interchangeably herein.

Similar to a semi-automatic pistol, when using a semi-automatic pistol replica 'non-gun' such as airsoft or BB guns, one can use a laser to simulate hits (for example via the barrel described in the above-mentioned U.S. Pat. No. 8,568,143). However, such use will prevent firing pellets, and one will be limited by the mechanism situated in the magazine and slide. As such, the mechanism will prevent the slide from sliding forward after every 'shot', indicating the magazine is empty.

An electronic target for use with a pulsed beam of laser light is described in U.S. Pat. No. 9,303,960 (Uhr, 2016 Apr. 5). Such targets allow non-live fire training (repeated drawing, aiming and firing without ammunition) in a practical, convenient manner to improve and/or maintain shooting techniques. U.S. Pat. No. 9,303,960 is incorporated by reference herein in its entirety.

SUMMARY OF THE INVENTION

The present invention relates to firearm training barrels and associated mechanisms therefor.

In accordance with embodiments of one aspect of the present invention there is provided a replacement or retrofittable barrel for replica guns, s which have a slide and a magazine, wherein the barrel includes a mechanism/member configured to allow continuous firing even if the magazine is empty. In accordance with some embodiments the mechanism/member is adjustable to also allow the option wherein firing is not possible when the magazine is empty.

The barrel's mechanism/member is configured so that it simulates the physical effect of a round (pellet) in the magazine. This effect is achieved by a member (e.g. projection or finger) that is positioned in the place of the 'next to be fired' pellet preventing the magazine follower from reaching the top of the magazine to thus disable the typical slide block/stop mechanism that prevents the gun slide from returning forward in the absence of pellets in the magazine. As a result of the member situated in the magazine, the gun can be fired continuously. Thus, no reloading or slide release is required, and in fact no pellets are needed or typically used; rather, a laser firing simulator or the like can be used). The aforementioned member (projection, finger or the like) in effect simulates the presence of a round or cartridge (typically a pellet/BB in an airsoft gun) in the magazine.

As such, typical replica guns do not need to be reconfigured to allow this continual firing (shooting); for example; there is no need to remove or limit the magazine follower or disable the slide blocker/slide stop or any other form of re-configuration. The barrel of existing replica guns can be replaced/retrofitted with the gun barrel of the present invention, either by the user or the manufacturer or simply supplied with the present gun barrel. No modification of the existing replica gun is required, other than using the barrel of the present invention.

The projection/finger may be adjustable (e.g. extendable, outwardly extracted or pivoted, etc.) to enter the magazine so that the barrel can be arranged to facilitate 'pellet free' continuous firing of the replica firearm (i.e. with the finger adjusted to simulate a round/pellet in the magazine whereby the slide continually operates/cycles). The projection/finger can also be arranged to be in a "finger-less" position (retracted/folded) whereby the slide acts in a standard manner, and, for example, the user receives the experience of the magazine emptying.

In other words, the invention provides a firearm training barrel for a replica gun, the gun having a slide and a magazine with a follower, wherein the barrel includes an extended or extendable member positioned or positionable to simulate the presence of one or more pellets in the magazine, whereby the replica gun slide block/stop mechanism is disabled.

In accordance with embodiments of another aspect of the present invention there is provided a replacement or retrofittable barrel for replica guns, having a slide and a magazine, wherein the barrel is configured to eject a pellet in a manner that simulates a spent casing/shell ejection, thereby providing a more realistic firing experience including realistically limiting the number of shots by the number of pellets in the magazine. This aspect provides for a more realistic firearm training experience.

The ejection effect is achieved by a curved tunnel (or equivalent) within the barrel that directs the pellet to eject from the barrel in a direction or manner that simulates a shell/casing ejection of a real firearm.

In some embodiments, the barrel further includes a pressure relief valve, vent or bleeder, typically in the form of a tunnel, to reduce the pressure on the pellet, whereby the pellet is ejected less forcefully so as to reduce the chance of injury to the user or a bystander. The pneumatic firing mechanism typically includes one or more of a gas capsule, a gas canister or has an associated compressor or tank with compressed gas.

In some embodiments, the aforementioned bleeder/vent has a calibration mechanism, e.g. a bleed adjustment screw.

BRIEF DESCRIPTION OF DRAWINGS

The invention may be more clearly understood upon reading of the following detailed description of non-limiting exemplary embodiments thereof, with reference to the following drawings, in which.

DETAILED DESCRIPTION OF EMBODIMENTS

The invention may be more dearly understood upon reading of the following detailed description of non-limiting exemplary embodiments thereof, with reference to the drawings.

The following detailed description of embodiments of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

Illustrative embodiments of the invention are described below. In the interest of clarity, not all features/components of an actual implementation are necessarily described.

Figure 1:
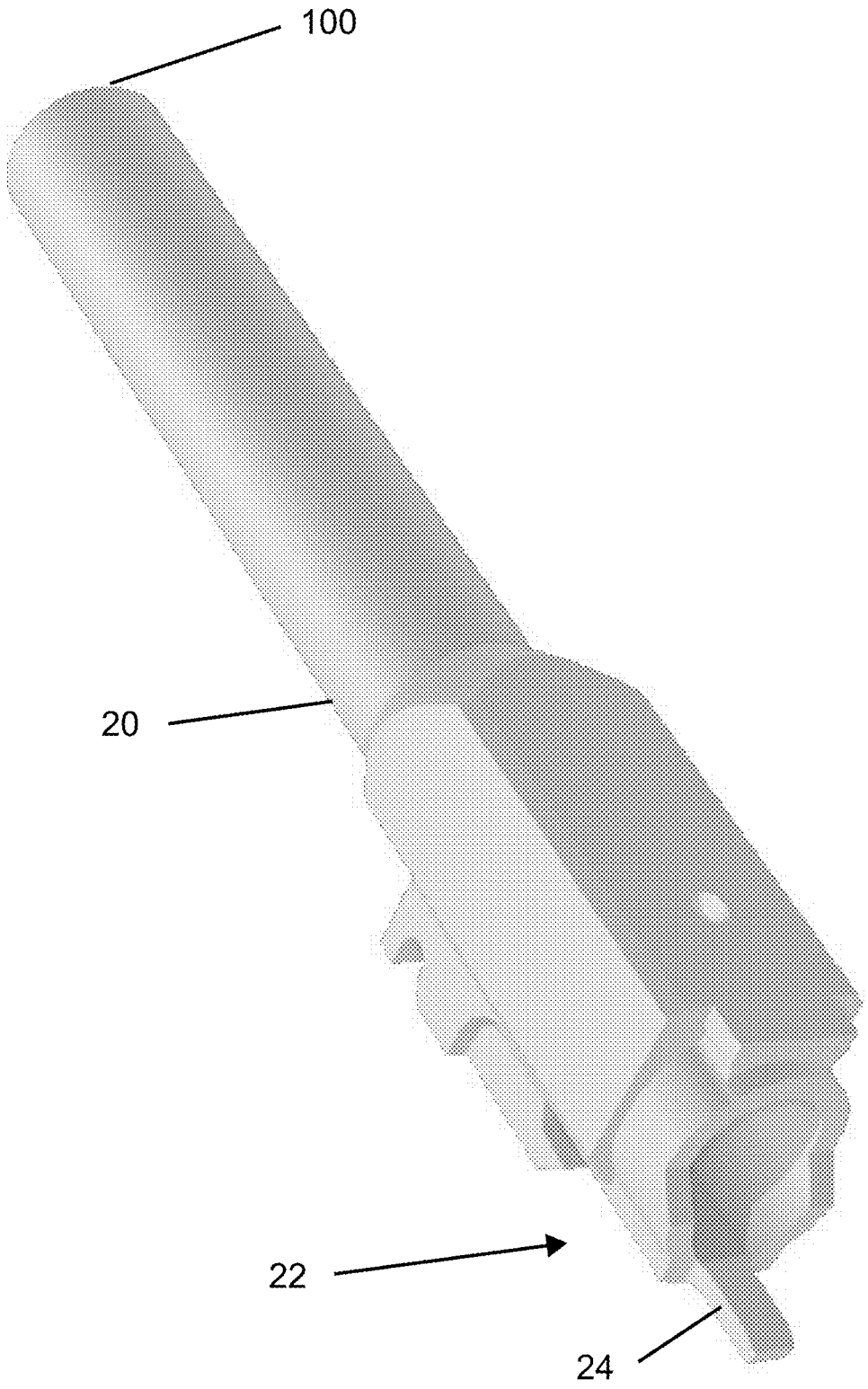
FIG. 1 is a perspective view of a barrel for firearm training, in accordance with embodiments of the present invention.

FIG. 1 shows a training barrel for a replica gun having a magazine and a slide, in accordance with the present invention. The training barrel is configured to allow repeated firing even when the gun's magazine has no rounds (pellets/BBs). The training barrel includes a barrel-like cylindrical extension 20; and a proximal end 22 dimensioned to operably replicate the geometry needed to fit into a replica gun. It is a particular feature of the training barrel wherein the barrel, in particular proximal end 22, further includes a member such as a projection or finger 24 that is configured, when the gun is assembled, to be situated in the magazine, particularly in the position of the 'top'/next pellet and to press on the magazine follower thereby preventing the follower (not shown) from arriving all the way to the top of the magazine and pressing on the slide blocker (aka: slide stop).

As a result, no pellets are needed during simulated firing, the gun's slide (not shown) will continue to operate continuously and thereby slide forward and back (racking) as if a cartridge (typically pellets/BBs in the case of a replica gun), is being loaded and fired, whereby the shooter can fire continually in a so-called "Hollywood style" manner (continuously). This continued forward and backward motion of the slide enables the shooter to continue firing without regard to the number of rounds that the magazine would have held if the magazine was actually loaded.

The training barrel may include a muzzle or distal portion 100 configured to hold a light emitting mechanism (not shown) such as a laser production and emitter device (e.g. laser pulse generator), which can be used to provide the shooter with a simulated bullet impact location.

Cylindrical extension 20 may be connected to, combined with, unified with or there may be situated within a light emitting mechanism (not shown) and/or optical pulse generator such as a laser production and emitter device (e.g. laser pulse generator), which can be used to provide the shooter with a simulated bullet impact location.

Figure 2A:
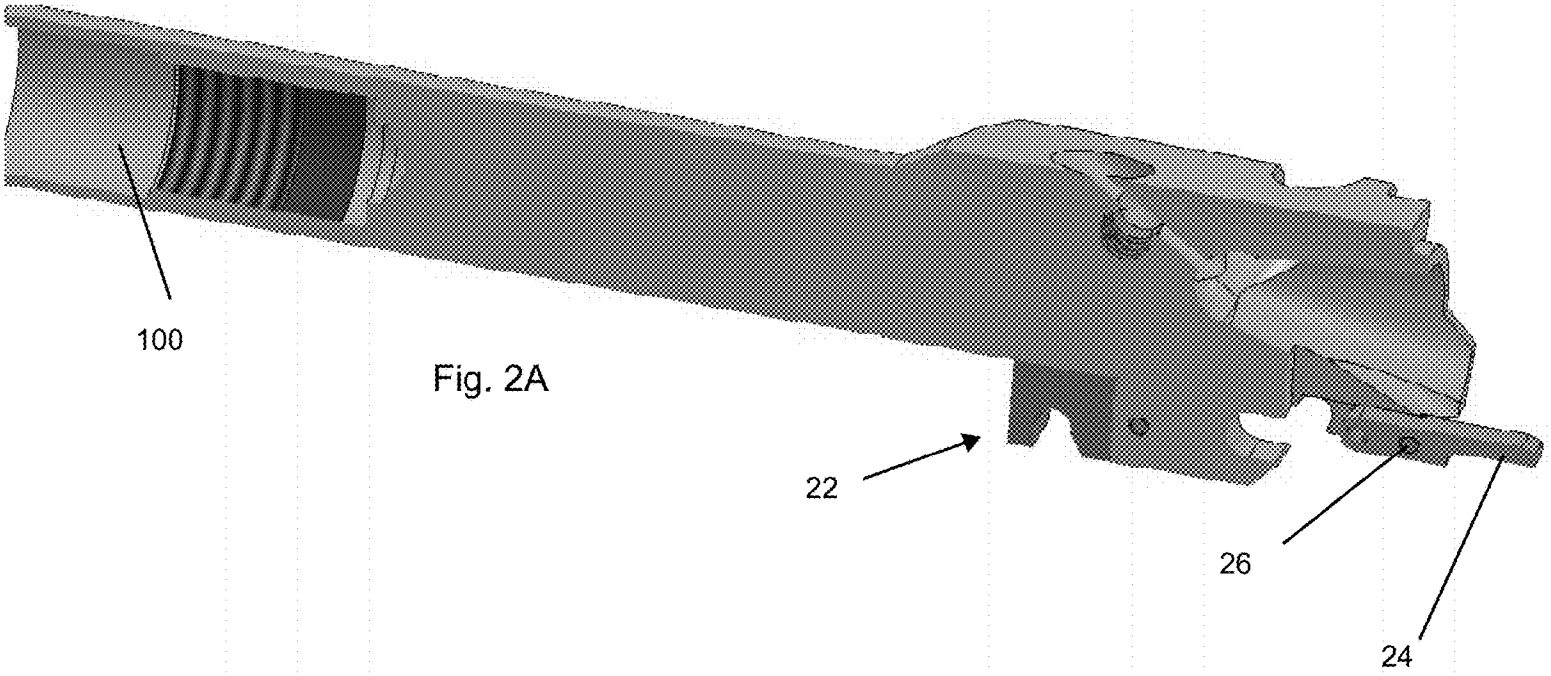
FIGS. 2A and 2B are cross sections of the barrel, in accordance with some embodiments, respectively showing an extendable member of the barrel in an extended and retracted position, extendable to simulate the presence of a round or cartridge in a firearm magazine, combined with a pellet ejection mechanism to simulate a spent casing/shell ejection.
Figure 2B:
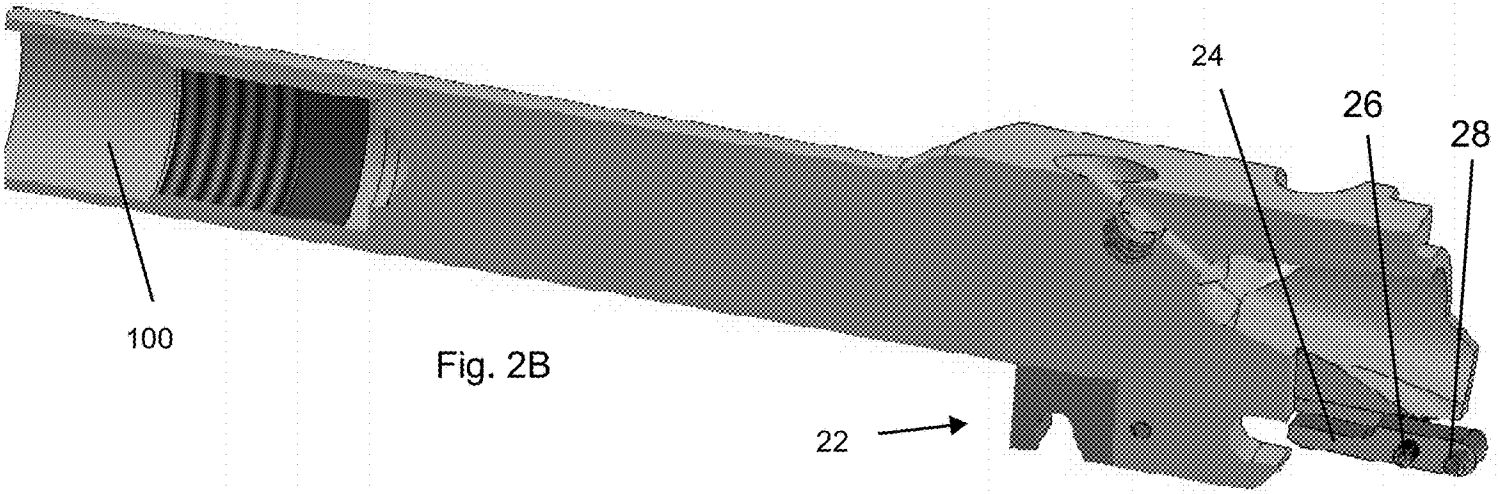

FIGS. 2A and 2B show an embodiment of projection/finger 24 configured so that it is arrange-able either in an active position, i.e. extended position (FIG. 2A), whereby the member (projection/finger) simulates the presence of a round (e.g. pellet) in the magazine and prevents the follower from arriving to the top of the magazine; or in a non-active position (FIG. 2B) (e.g. retracted or folded position) wherein the projection/finger is not positioned in the magazine. Depending on the actual mechanism used, projection/finger 24 may have an associated pivot pin 26; a folding/pivoting mechanism (or an extension/retraction mechanism (not shown); removal/attachment mechanism (not shown); or other suitable mechanism—hereinafter "folding/pivoting mechanism" or derivative thereof. This option to arrange projection/finger 24 in a non-active (folded/retracted/removed) position allows the follower to arrive to the top of the magazine whereby the gun can be fired with pellets/BBs. These configurations can be utilized in combination with a light emitting mechanism and/or optical pulse generator connected to, situated-in or unified with barrel-like cylindrical extension 20 or/and or distal portion 100. The folding/pivoting mechanism can further include a fastener such as a screw or finger locking pin 28 to secure finger 24 in the desired position.

Figure 3:
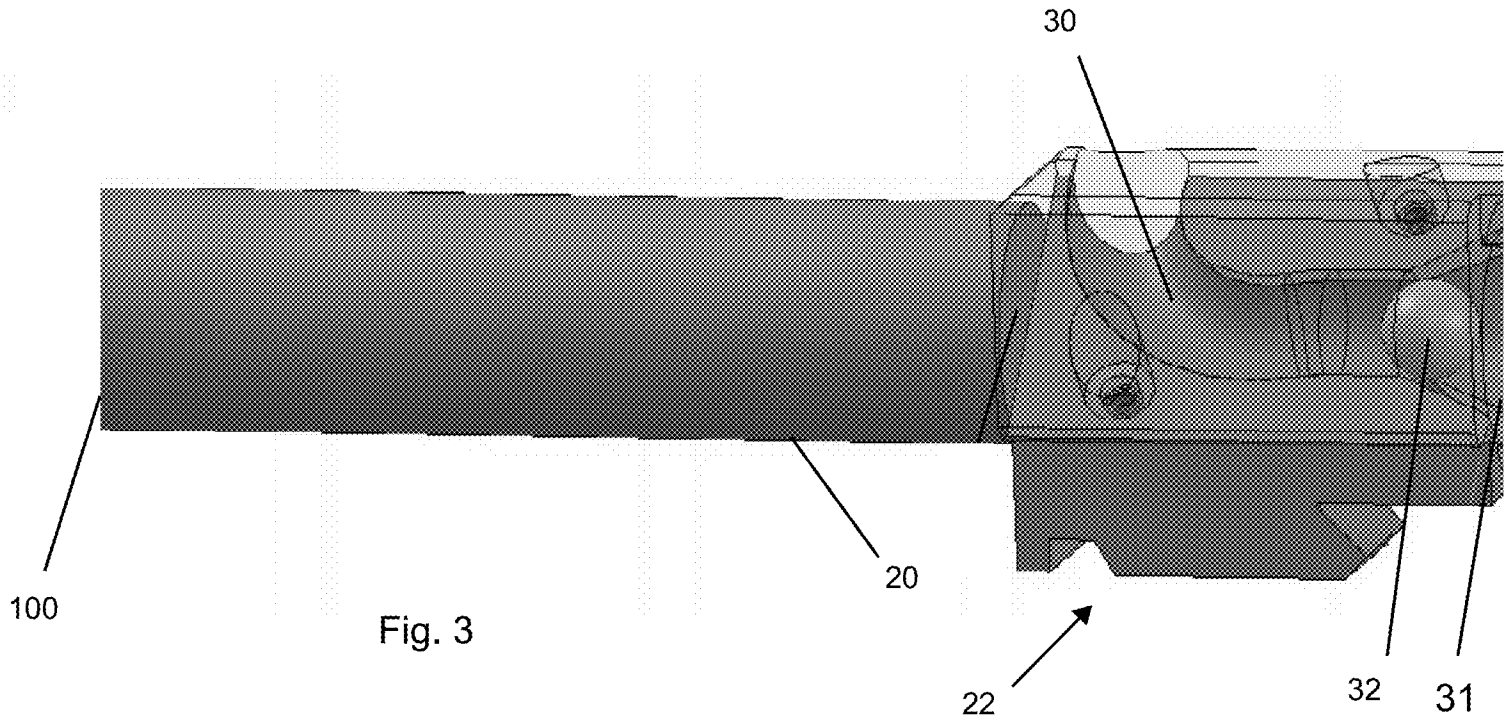
FIG. 3 is a perspective view of the barrel with a cut-away showing the inner portion of its proximal end including a pellet ejection mechanism, in accordance with some embodiments.

FIG. 3 shows a barrel whose proximal end 22 is designed to be used with a magazine holding pellets (not visible) or the like and to eject those pellets in a manner so as to simulate a casing ejection in a real firearm. In other words the pellets are ejected upward and sideways from proximal end 22 of the barrel upon firing, at an angle similar to that of a shell/casing ejection. The pellets are shot using the existing firing mechanism of the replica gun using pressurized gas from a capsule or canister or compressor (not shown, and known per se) or using an associated gas tank with a hose (not shown, and known per se) or the equivalent—referred to hereinafter as "canister", "gas canister", "pressurized gas canister" or derivatives thereof.

In some embodiments, this casing ejection simulation is achieved by proximal end 22 including a curved tunnel 30 (FIG. 3) that curves upwardly and to the side, and that is dimensioned to facilitate passage of the pellets from a chamber 31 and direct those pellets upward and to the side.

Figure 4:
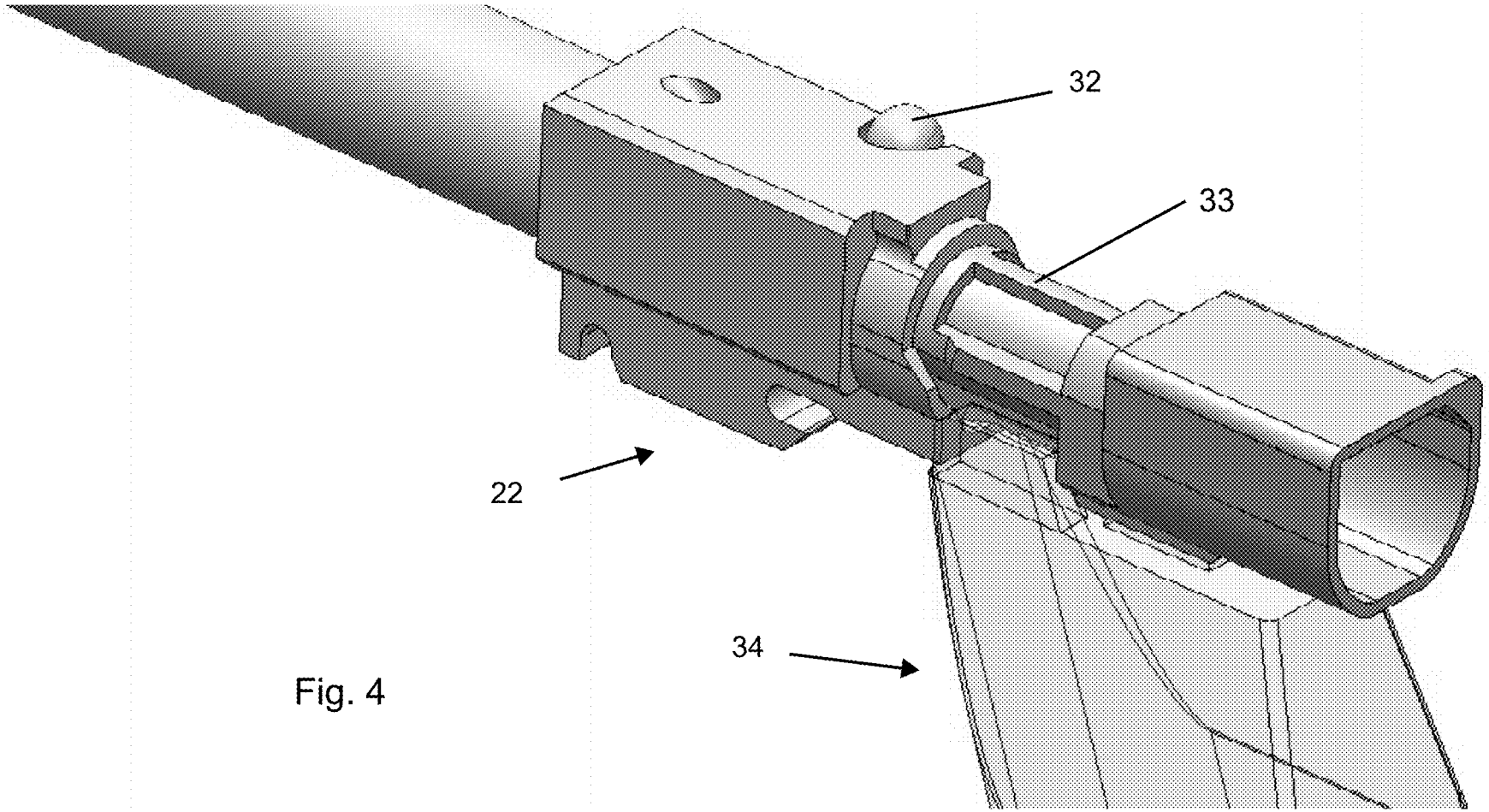
FIG. 4 is a perspective view of the barrel showing a pellet about to be ejected therefrom.

FIG. 4 shows a pellet 32 about to be ejected from curved tunnel 30 (not visible in this view), simulating a casing ejection. An upper portion of a magazine 34 is visible as well as the gun's nozzle 33.

Figure 5A:
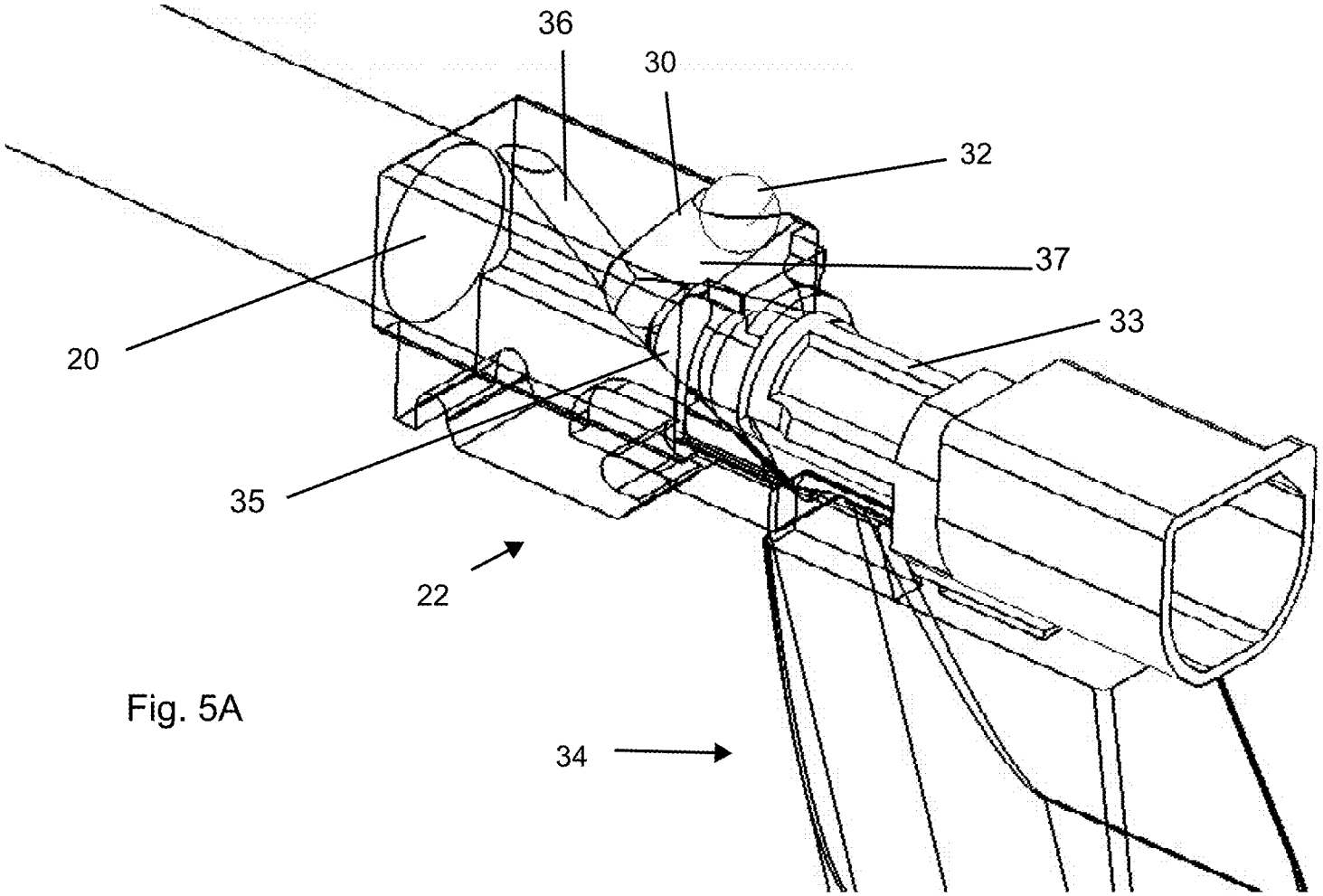
FIGS. 5A and 5B show different views of the barrel of FIG. 4.
Figure 5B:
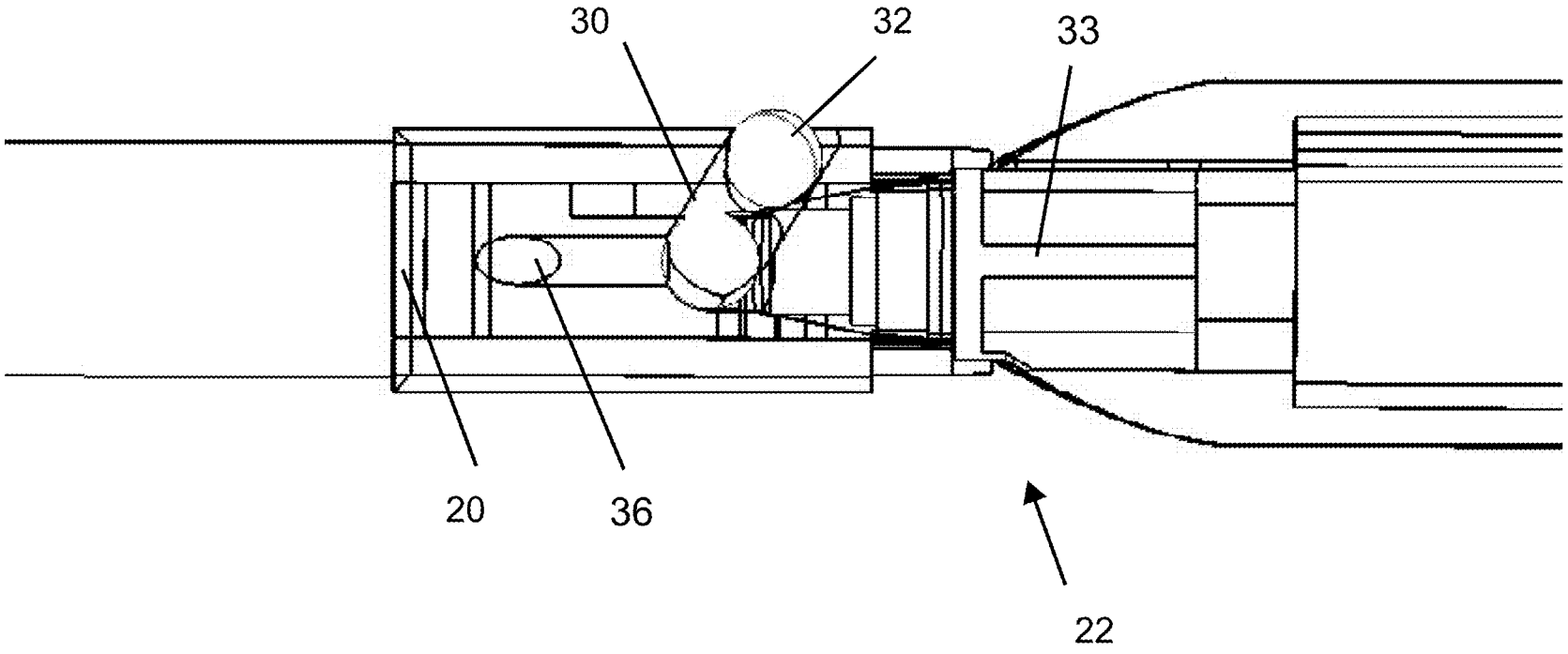

FIGS. 5A and 5B show an embodiment wherein curved tunnel 30 includes two sections: a pellet loading ramp 35 and a pellet ejection tunnel 37. Loading ramp 35 facilitates the passage of pellet 32 just after the pellet is pushed from magazine 34 by nozzle 33 to loading ramp 35. Preferably, loading ramp 35 slightly diverges from the center/longitudinal axis of nozzle 33 towards the direction in which pellet 32 is intended to be ejected. Ejection tunnel 37 is at an angle with respect to loading ramp 35.

FIGS. 5A and 5B also show an embodiment wherein proximal end 22 further includes a vent tunnel 36 associated with curved tunnel 30 to bleed off some of the propellant gas and lower the gas pressure produced by the firing mechanism. Vent tunnel 36 may be oriented to bleed off the gas in a forward direction, for example through barrel-like cylindrical extension 20. By reducing the propellant gas pressure, Vent tunnel 36 can facilitate the proper ejection of the pellets from curved tunnel 30, in particular in a safe manner rather than a rapid ejection, which can potentially be dangerous for the shooter or someone standing nearby. Vent tunnel 36 can be dimensioned during manufacturing so as to produce a casing-simulating pellet ejection with an appropriate pellet ejection speed.

Figure 5C:
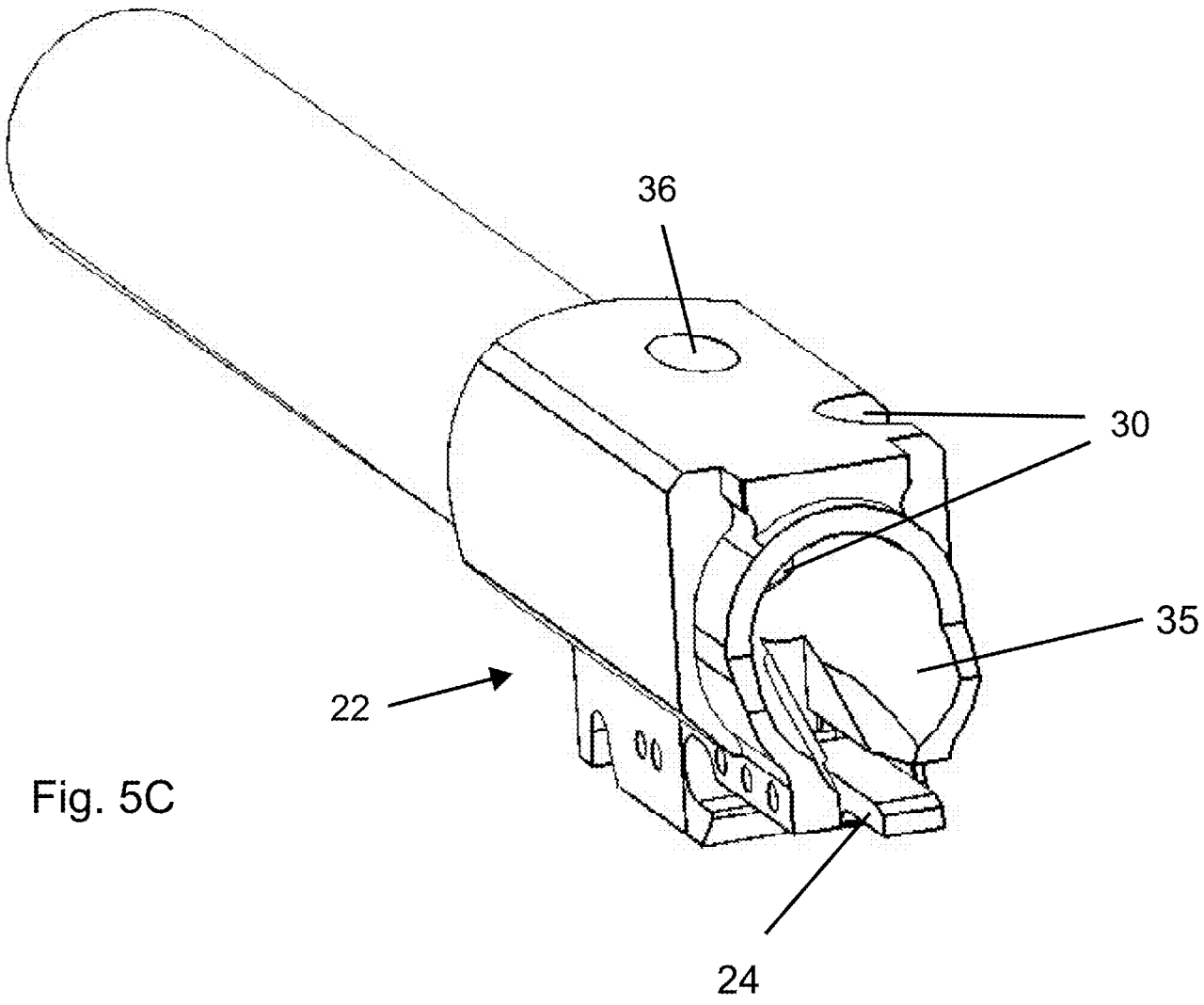
FIG. 5C show an additional embodiment the barrel of FIG. 4.

FIG. 5C shows an embodiment in which projection/finger 24 facilitates the "folding/pivoting mechanism" configuration, which provides the user with the option of using the training barrel with or without pellets—i.e. without pellets, when finger 24 is extended/open (FIG. 2A); and with pellets and a simulated shell ejection when finger 24 is folded/retracted (FIG. 2B).

Figure 6A:
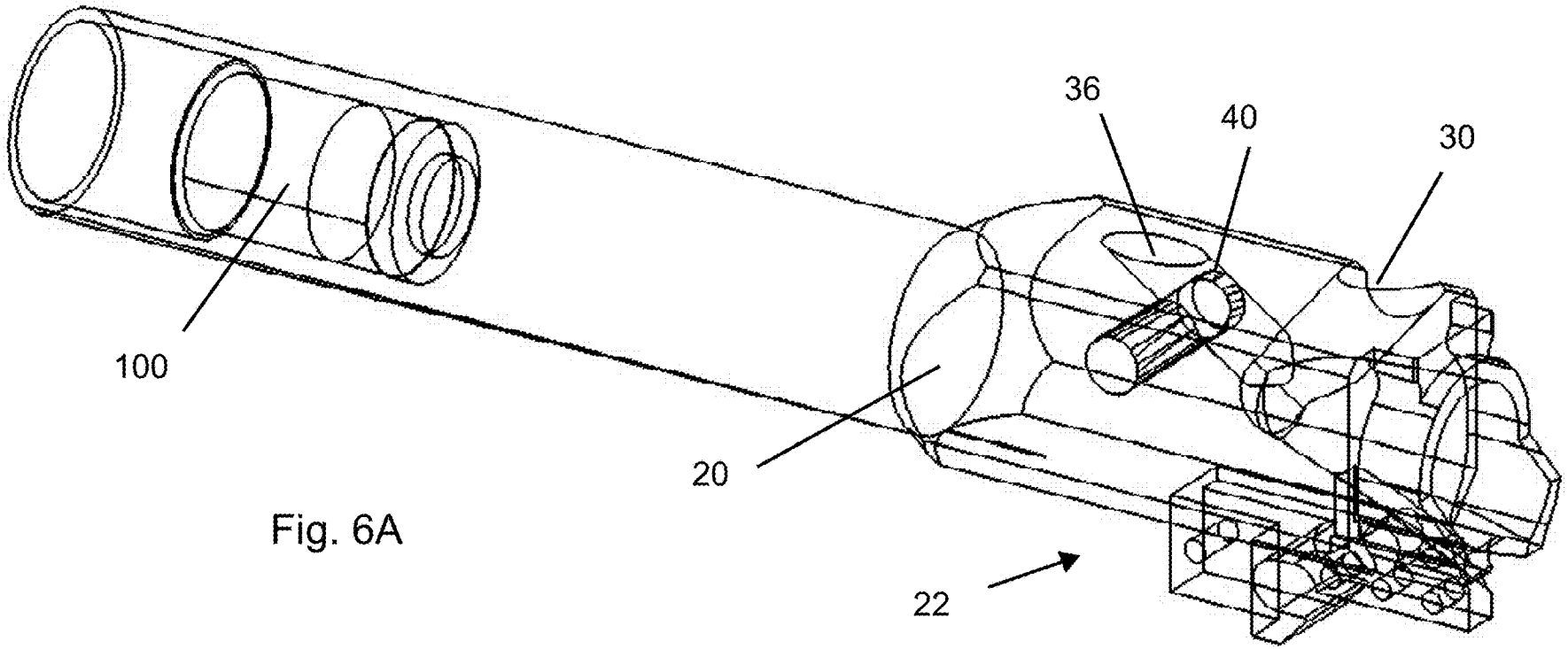
FIGS. 6A and 6B show further variations on the barrel of FIG. 4.
Figure 6B:
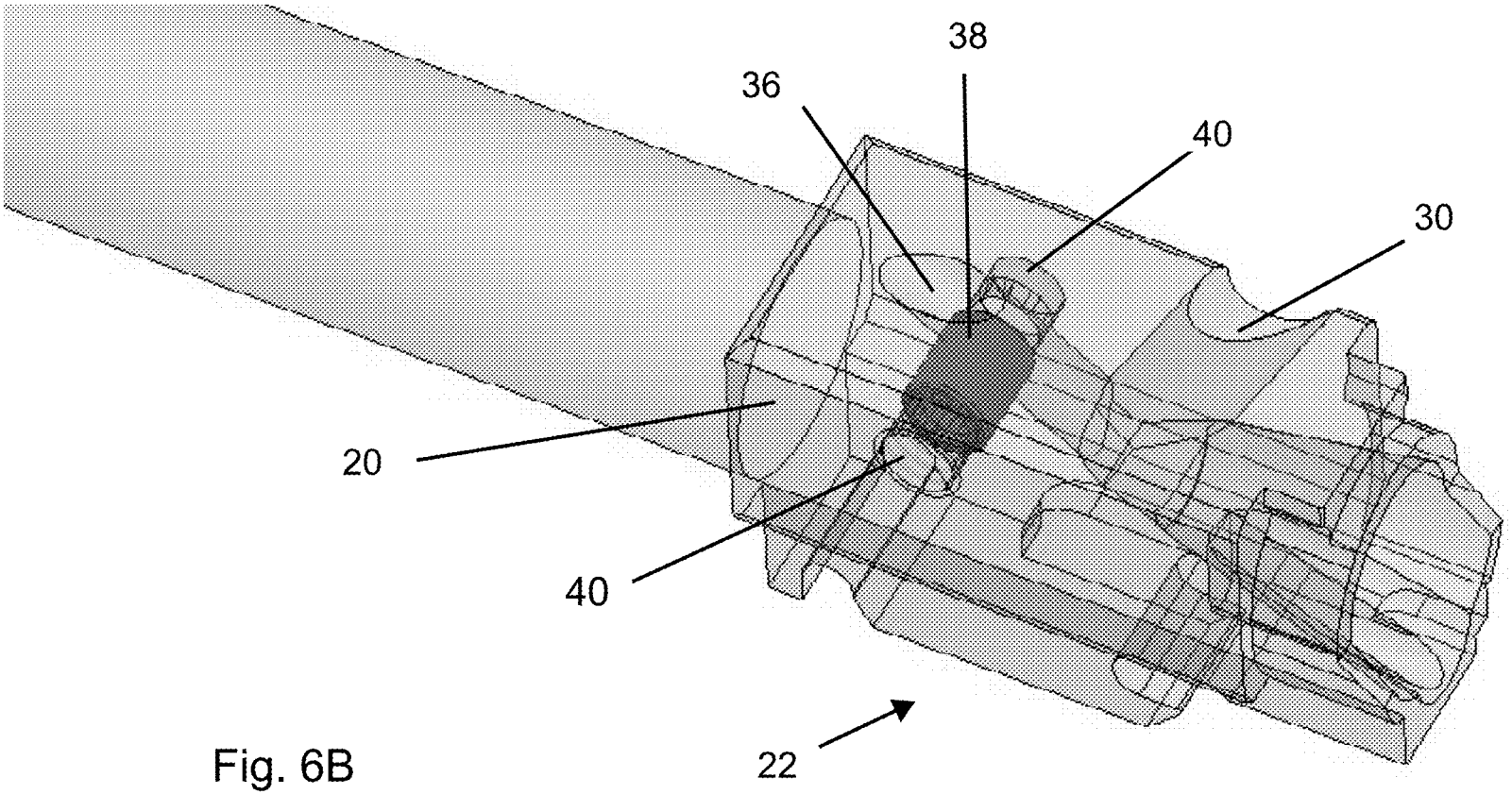
Figure 7A:
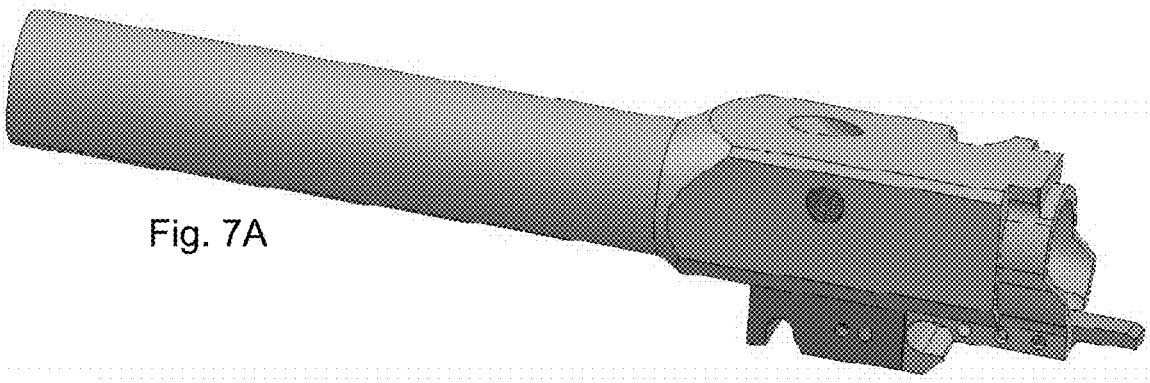
FIGS. 7A-7D show cross sectional views of the barrel including the embodiments shown in FIG. 2A and FIG. 2B.
Figure 7B:
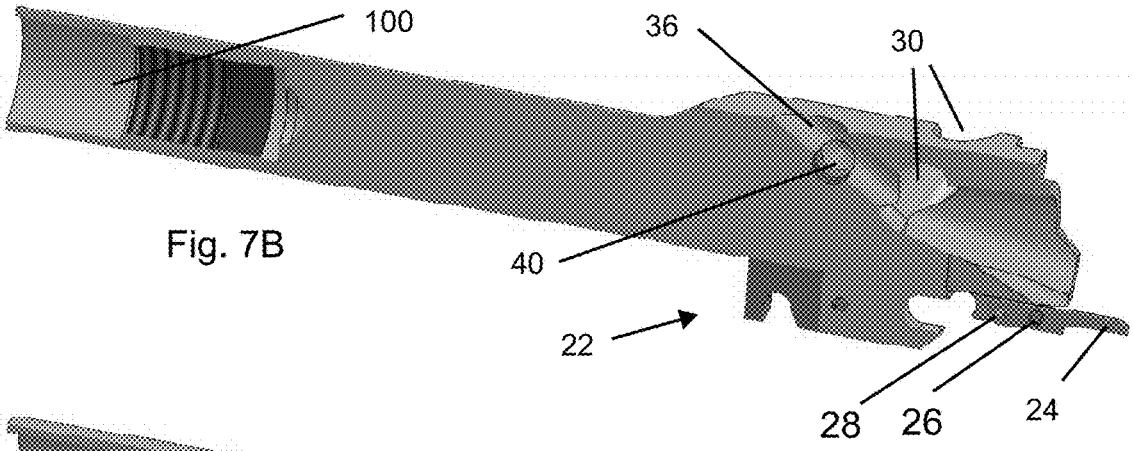
Figure 7C:
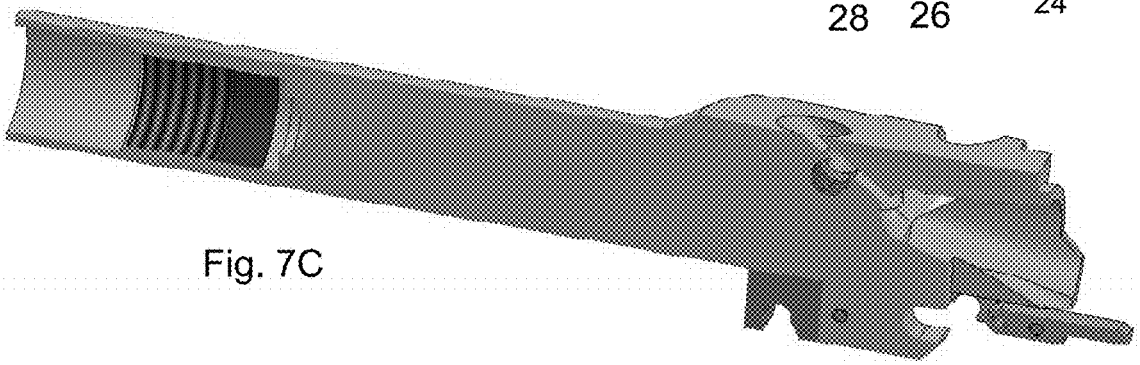
Figure 7D:
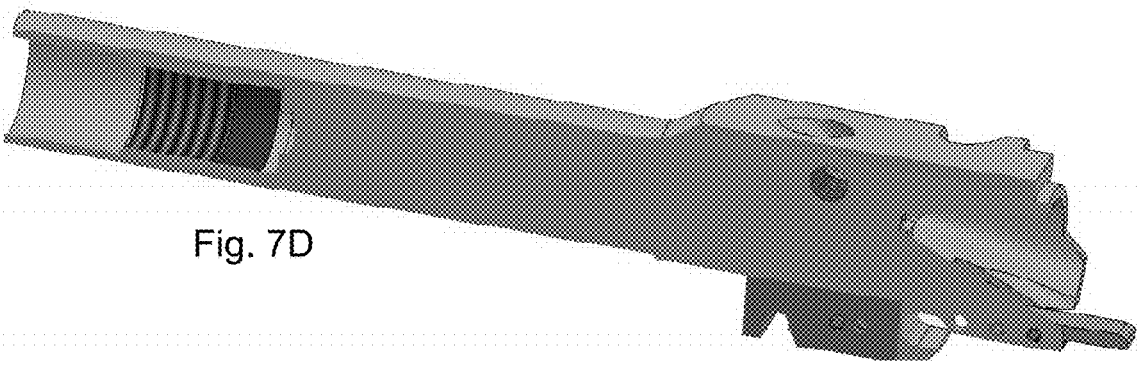

FIGS. 6A and 6B show an embodiment wherein vent tunnel 36 has an associated bleed adjustment mechanism including a bleed screw 38 and a threaded lumen 40 whereby the amount of bleeding via the vent tunnel 36 can be set, controlled or calibrated in order to further provide a post-production adjustment option for the user. As such, the speed of the casing-simulating is pellet ejection can be adjusted.

FIGS. 7A-7D illustrate an embodiment including a combination of a "folding/pivoting mechanism" finger 24; vent tunnel 36; distal portion 100; and threaded lumen 40 for receiving bleed adjustment screw 38 (FIG. 6B).

It should be understood that the above description is merely exemplary and that there are various embodiments of the present invention that may be devised, mutais mutandis, and that the features described in the above-described embodiments, and those not described herein, may be used separately or in any suitable combination; and the invention can be devised in accordance with embodiments not necessarily described above.

The invention claimed is:

1. A barrel for a replica gun, the gun having a slide and a magazine with a follower, wherein the barrel comprises:

a barrel-like cylindrical extension;

a proximal end dimensioned to operably fit into a replica gun as a barrel and an extended member extending from the proximal end, wherein when the replica gun is assembled, the member is positioned to substitute the 'next to be fired' pellet in the magazine by pressing into the magazine and against the magazine follower.

2. The barrel of claim 1, wherein the member can also be configured to be positionable elsewhere.

3. The barrel of claim 2, wherein the member is configured to be foldable.

4. The barrel of claim 2, wherein the member is configured to be retractable.

5. The barrel of claim 2, wherein the member is configured to be pivotable.

6. The barrel of claim 2, wherein when the member is not positioned in the magazine the replica gun allows use of pellets.

7. The barrel of claim 1, wherein the replica gun can be continually fired with a magazine with no pellets.

* * * * *